US006731766B2

(12) United States Patent
Yasuno et al.

(10) Patent No.: US 6,731,766 B2
(45) Date of Patent: May 4, 2004

(54) CONDENSER MICROPHONE AND PRODUCTION METHOD THEREOF

(75) Inventors: Yoshinobu Yasuno, Tokyo (JP); Yasuhiro Riko, 1988-34, Kitahassaku-cho, Midori-ku, Yokohama-shi, Kanagawa 226-0021 (JP)

(73) Assignees: Matsushita Electric Industrial Co., Ltd., Osaka (JP); Yasuhiro Riko, Kanagawa (JP)

( * ) Notice: Subject to any disclaimer, the term of this patent is extended or adjusted under 35 U.S.C. 154(b) by 0 days.

(21) Appl. No.: 10/208,609

(22) Filed: Jul. 30, 2002

(65) Prior Publication Data

US 2003/0026443 A1 Feb. 6, 2003

(30) Foreign Application Priority Data

Jul. 31, 2001 (JP) ..... 2001-232457

(51) Int. Cl.[7] ..... H04R 25/00
(52) U.S. Cl. ..... 381/171; 381/175; 381/113
(58) Field of Search ..... 381/170, 171, 381/172, 173, 174, 175, 355, 176, 177, 113, 116, 190, 191

(56) References Cited

U.S. PATENT DOCUMENTS

| | | | | |
|---|---|---|---|---|
| 3,858,307 A | | 1/1975 | Yoshimura et al. | 29/594 |
| 3,946,422 A | | 3/1976 | Yagi et al. | 357/26 |
| 6,243,474 B1 | * | 6/2001 | Tai et al. | 381/174 |

FOREIGN PATENT DOCUMENTS

| | | | |
|---|---|---|---|
| EP | 0 549 200 A1 | 6/1993 | H04R/1/40 |
| JP | 11-111565 | 4/1999 | |
| JP | 11-117172 | 4/1999 | |

* cited by examiner

*Primary Examiner*—Curtis Kuntz
*Assistant Examiner*—Brian Ensey
(74) *Attorney, Agent, or Firm*—Pearne & Gordon LLP

(57) ABSTRACT

A condenser microphone has a conductive diaphragm 3 having an earth electrode layer 31 formed of a conductive light metal; a conductor fixed electrode 5 arranged opposite to the conductive diaphragm 3 through an air layer; an organic dielectric layer 32 formed of the organic compound provided on the boundary surface 32C side between the air layer and the conductive diaphragm 3; and a permanent electric charge layer 32A composed of ions or electrons formed in the inner portion side receding from the air layer 8 side, from a middle position in the thickness direction of the organic dielectric layer 32 in the inside of the organic dielectric layer 32.

9 Claims, 5 Drawing Sheets

CONDENSER MICROPHONE AND PRODUCTION METHOD THEREOF

BACKGROUND OF THE INVENTION

This invention relates to a condenser microphone which can be operated without feeding from the outside, in that electric charges are injected from the outside to electret (polarization), and production method thereof.

As is generally well known, the condenser microphone is structured in such a manner that it has a conductive diaphragm and a conductive fixed electrode (hereinafter, called conductor fixed electrode) oppositely arranged through the air layer in parallel with the conductive diaphragm, and the change of the capacitance between the conductive diaphragm and the conductor fixed electrode due to the vibration of the diaphragm is detected as the sound pressure on the diaphragm. In this case, in order to output the detection as an electric signal, between two conductors (conductive diaphragm and the conductor fixed electrode), the DC voltage is previously supplied to form the positive potential, and as its change, the change of the capacitance is detected as the electric signal. Further, it is well known that the magnitude of the output voltage to a unit sound pressure, that is, the sensitivity, is proportional to the applied DC voltage.

The positive potential is, although there is a case where it is supplied from the outside DC power source, recently, a method to use so-called electret (dielectric at least one portion of which is polarized) by which the dielectric film such as FEP (fluoro ethylene propylene) is attached to any opposing surface of, for example, the conductive diaphragm or conductor fixed electrode, and the electric charge is injected into and fixed onto the dielectric film, and from the electric field formed by the electric charge, the electric potential corresponding to the positive voltage is obtained, is developed, Thereby, the condenser microphone in which the outside DC power source is not necessary, is put to practical use.

Next, referring to FIG. 5, this electret type condenser microphone will be described.

In FIG. 5, in the inside of the housing 101, a diaphragm plate ring 102, electret forming-use dielectric 104 which is a portion of the diaphragm, spacer 105, fixed electrode 106, and insulation ring 107 are provided. This dielectric 104 is structured by a thin film such as FEP, and on the outer surface, the metal such as gold or nickel is attached by evaporation, and the film on which the function as the earth electrode 103 is given is provided. On the fixed electrode 106, a vent hole 106A is formed. Further, to this fixed electrode 106, the output terminal 108 is connected, and the potential difference (voltage) between the housing 101 and it, is obtained.

As the injection method of the electric charge into the dielectric 104 for the electret formation, each kind of method in which an electron beam is used or corona discharge is used, is proposed. Further, when the injection of the electric charge is conducted by these methods, there is some difference in the depth into which the electric charge is injected depending on the adopted method. For example, in the electron beam, although the injection can be conducted deeply to some degree, also by the method, the electric charge to be injected is fixed to very shallow portion of several tens $\mu$m at the most from the surface.

That is, this is for the reason why, when dielectric film for forming the electret is used as the conductive diaphragm, generally, the conductor metal is formed on its outside as the above earth electrode by a method of the evaporation, the film thickness of about several tens $\mu$m. In many case, as the conductor metal, the heavy metal such as nickel or gold is used. However, even when ion irradiation is conducted, of course, by the high temperature electric field method, or by the method of the electron beam, ion flow, or other method, the ion can not penetrate the film of the conductor metal for which such the heavy metal is used.

Accordingly, when the injection electric charge is fixed in very shallow portion in this manner, when, with this surface, the electrolyte such as, for example, the water, the conductor such as the metal, or non-insulating body such as the human skin is brought into contact, there is a possibility that it is easily discharged through the shallow distance, and the injected electric charge is dissipated, and the function as the microphone is destroyed or damaged.

Accordingly, as the conventional electric charge injection method, generally, it is conducted from the surface on the opposite side of the surface onto which this conductor metal is attached, that is, from the inner surface side of the dielectric 104 facing the air layer 109.

From such the conditions, conventionally, the electric charge injection is conducted before the product is assembled as the microphone, and the electret is previously formed as a part, and it is necessary that, by using this, the assembling is conducted. As the result, when the non-insulating body such as the human body is brought into contact with the formation surface of the electret, or it is exposed to the excessive humidity during the conservation as the part, the electric charge injected at no small pains is discharged, and there is a problem that the performance as the microphone after the assembly is spoiled.

SUMMARY OF THE INVENTION

Accordingly, in view of the above conditions, the object of the present invention is to provide a high reliable condenser microphone and its production method by which the injection of the electric charge can be conducted from the metal coating surface after the assembly of the microphone, not only the assembly becomes easy, but after the dielectric is sufficiently washed, it is maintained in the hermetically sealed condition, and is strong to the water or humidity, and even when the environmental condition such as the humidity or temperature is severe, the excellent electric sound conversion characteristic can also be maintained.

According to the first aspect of the invention, a condenser microphone comprises: a conductive diaphragm having an earth electrode layer formed of a conductive light metal; a conductor fixed electrode arranged opposite to the conductive diaphragm through an air layer; an organic dielectric layer formed of the organic compound provided on the boundary surface side between the air layer and the conductive diaphragm; and a permanent electric charge layer composed of ions or electrons formed on the earth electrode layer side from a middle position in the thickness direction of the organic dielectric layer in the inside of the organic dielectric layer.

Thereby, the electric field can be injected by penetrating the metallic surface of the earth electrode layer, for example, like that the corona discharge is generated in the air and ions are formed and accelerated by the electric field.

Further, in the present invention, the inside of the organic dielectric layer from the permanent electric charge layer to the inner end surface contacting with the air layer is made to the electret, and has the electric potential.

Thereby, without feeding the power from the outside, the condenser microphone can be operated.

Further, in the present invention, the organic dielectric layer has 1–50 μm film thickness, and it is preferable that the earth electrode layer is formed by making the conductive light metal into the film of not larger than 0.1 μm thickness on the organic dielectric layer.

Further, in this invention, the organic dielectric layer may be formed by using any one of FEP (fluoro ethylene.propylene), PFA (polyfluoro.acetal), and PTFE (polytetra.fluoroethylene)

According to the second aspect of the invention, a condenser microphone comprises: a conductive diaphragm having an earth electrode layer formed of a conductive light metal; a conductor fixed electrode arranged opposite to the conductive diaphragm through an air layer; an inorganic or organic dielectric layer formed of the inorganic oxide or the organic compound provided on the boundary surface side between the air layer and the conductor fixed electrode; and a permanent electric charge layer composed of ions or electrons formed on the conductor fixed electrode side from the middle in the thickness direction of the inorganic or organic dielectric layer in the inside of the inorganic or organic dielectric layer.

Thereby, the electric field can be injected by penetrating the metallic surface of the earth electrode layer, like that, for example, the corona discharge is generated in the air, and ions are formed and accelerated by the electric field.

Further, the present invention can be structured in such a manner that the inside of the inorganic or organic dielectric layer from the permanent electric charge layer to the inner end surface contacting with the air layer is made to the electret, and has the electric potential.

Thereby, without feeding the power from the outside, the condenser microphone can be operated.

Further, in this invention, the dielectric layer whose thickness is not larger than 4 μm, formed of the organic compound is used for the conductive diaphragm, and it is preferable that the earth electrode layer is provided by making the conductive light metal into the film of not larger than 0.1 μm thickness on the organic dielectric layer.

Further, in this invention, the silicon dioxide ($SiO_2$) of not smaller than 1 μm thickness can be used for the inorganic or organic dielectric layer.

Further, in this invention, it is preferable that a circular hole whose inner diameter is not smaller than 1.0 mm is formed on the outer surface of a housing which accommodates the conductive diaphragm and the conductive fixed electrode.

According to the third aspect of the invention, a production method of the condenser microphone which has the conductive diaphragm having the earth electrode layer formed of the conductive light metal, the conductor fixed electrode arranged opposite to the conductive diaphragm through the air layer, the organic dielectric layer formed of the organic compound provided on the boundary surface side between the air layer and the conductive diaphragm, and the permanent electric charge layer composed of ions or electrons formed in the inner portion receding from the air layer side to the middle position in the thickness direction of the organic dielectric layer in the inside of the organic dielectric layer, the production method of the condenser microphone comprises the steps of: after the condenser microphone is assembled, injecting ionized objects or electrons accelerated into the organic dielectric layer from the outside of the conductive diaphragm to form the permanent electric charge layer.

Thereby, not only the assembly becomes easy, but after the organic dielectric layer is sufficiently washed, it is maintained in the hermetically sealed condition, and is strong to the water or humidity, and even under the condition that the environmental condition such as the humidity or temperature is severe, the excellent electric sound conversion characteristic can also be maintained.

According to the fourth aspect of the invention, a production method of the condenser microphone which has the conductive diaphragm having the earth electrode layer formed of the conductive light metal, the conductor fixed electrode arranged opposite to the conductive diaphragm through the air layer, the inorganic or organic dielectric layer formed of the inorganic oxide or the organic compound provided on the boundary surface side between the air layer and the conductive diaphragm, and the permanent electric charge layer composed of ions or electrons formed in the inner portion receding from the air layer side, from the middle in the thickness direction of the inorganic or organic dielectric layer in the inside of the inorganic or organic dielectric layer, the production method of the condenser microphone comprises the steps of: after the condenser microphone is assembled, injecting ionized objects or electrons accelerated into the inorganic or organic dielectric layer from the outside of the conductive diaphragm to form the permanent electric charge layer.

Thereby, not only the assembly becomes easy, but after the inorganic dielectric layer is sufficiently washed, it is maintained in the hermetically sealed condition, and is strong to the water or humidity, and even under the condition that the environmental condition such as the humidity or temperature is severe, the excellent electric sound conversion characteristic can also be maintained.

BRIEF DESCRIPTION OF THE PREFERRED EMBODIMENTS

DETAILED DESCRIPTION OF THE PREFERRED EMBODIMENTS

Figure 1:
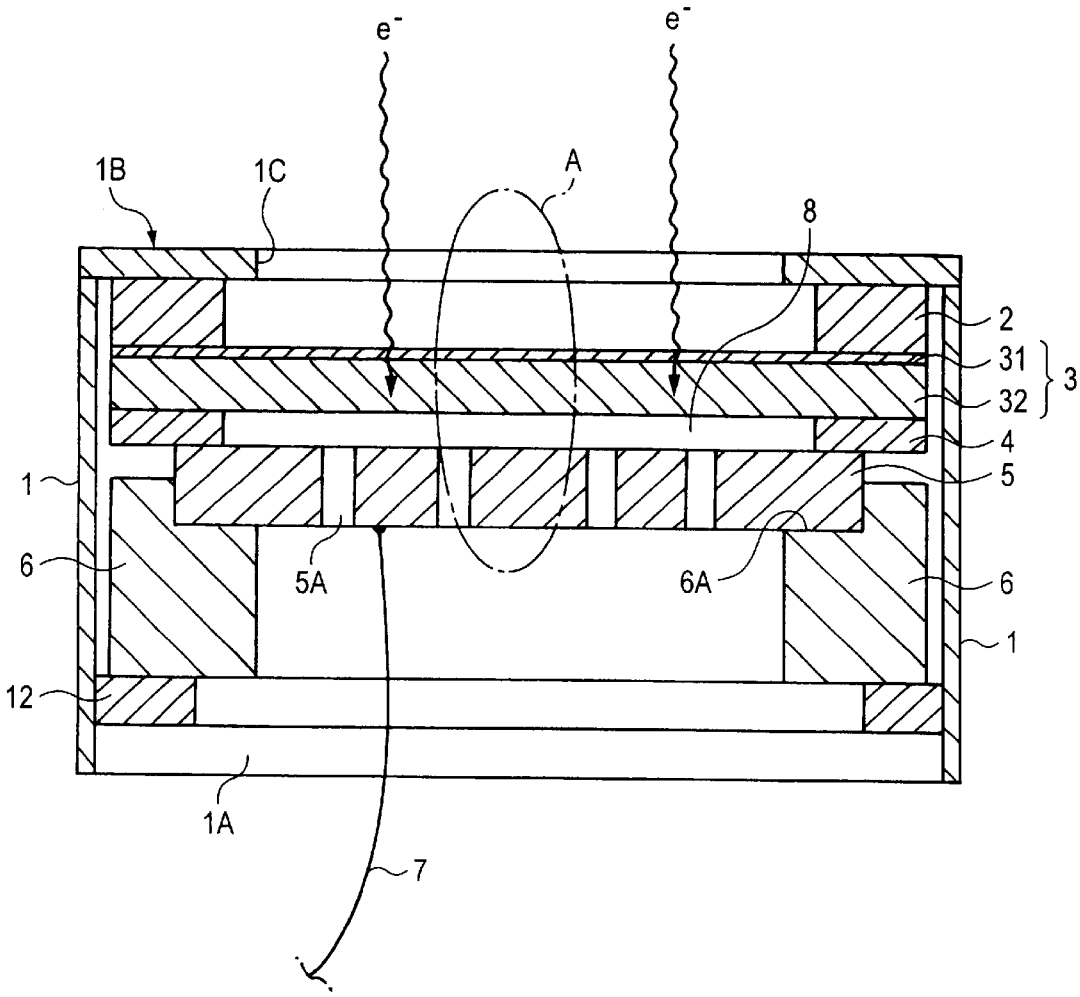
FIG. 1 is an outline sectional view showing a condenser microphone according to the first embodiment of this invention.

Referring to the drawings, embodiments of the present invention will be described below.

[First Embodiment]

FIG. 1 shows an enlarged typical view of a main portion according to the electric sound conversion in the basic structure of the electret condenser microphone according to the first embodiment of the present invention. This electret condenser microphone includes, in a housing 1 inside, a diaphragm plate ring 2, conductive diaphragm 3 having an earth electrode (hereinafter, called outside electrode layer 31), spacer 4, conductor fixed electrode (hereinafter, called inside electrode) 5, and insulation ring 6, and from this housing 1, an output terminal 7 outputting the voltage (potential difference) between the fixed electrode 5 and housing 1, is drawn out.

The hosing 1 is formed hollow cylinder-like, and the whole of the base end surface is opened and forms a large aperture portion 1A, and in the leading edge surface (outer surface) 1B constituting a lid, a circular hole 1C whose diameter is not smaller than 1.0 mm, is provided. Further, in the inside of the housing 1, an almost ring-like seal member 12 is interposed and fixed, and the slip-out of the insulation ring 6 is prevented.

The diaphragm plate ring 2 fixes the periphery of the diaphragm 3, and is formed into almost ring-like, and is fixed on the leading edge of the inside of the housing 1.

The diaphragm 3 is provided with the organic dielectric layer 32 composed of the outside electrode layer 31 which is the earth electrode, and the organic compound, in the order from the component of the outside. In them, the outside electrode layer 31 is formed by using specially the light metal in the conductive metals. That is, this is for the reason why, when the (conductive) heavy metal such as gold (Au) or nickel (Ni) is used, it is difficult that the injection of ion (electric charge) or electron is conducted by making them penetrate this metallic surface.

Therefore, in this embodiment, on the outside electrode layer 31, as the conductive light metal, for example, aluminium (Al) is used, and this is made into the film whose thickness is not larger than 0.1 $\mu$m, on the organic dielectric layer 32 by galvanizing, evaporation, or spattering. In this case, in the input circuit connected to the microphone, because the input resistance is not smaller than 1000 MΩ, it is not a problem that the resistance value of the outside electrode layer 31 is larger than the case where the conventional heavy metal is used. In this connection, in this embodiment, although aluminium is used as the conductive light metal, the conductive light metal other than this, for example, beryllium (Be) may be used.

On the one hand, the organic dielectric layer 32 is arranged opposing to the conductor fixed electrode 5 in parallel condition through the air layer 8, and in this embodiment, as the dielectric film, FEP (fluoro ethylene.propylene) whose thickness is 12.5 $\mu$m, is used. Into this organic dielectric layer 32, after each member constituting the electret condenser microphone is assembled, ion (electric charge) or electron is injected from the outside of the outside electrode layer (conductor coating layer) 31, thereby, the permanent electric charge layer 32A is formed in the inside, and the bias electric charge can be formed.

Figure 2A:
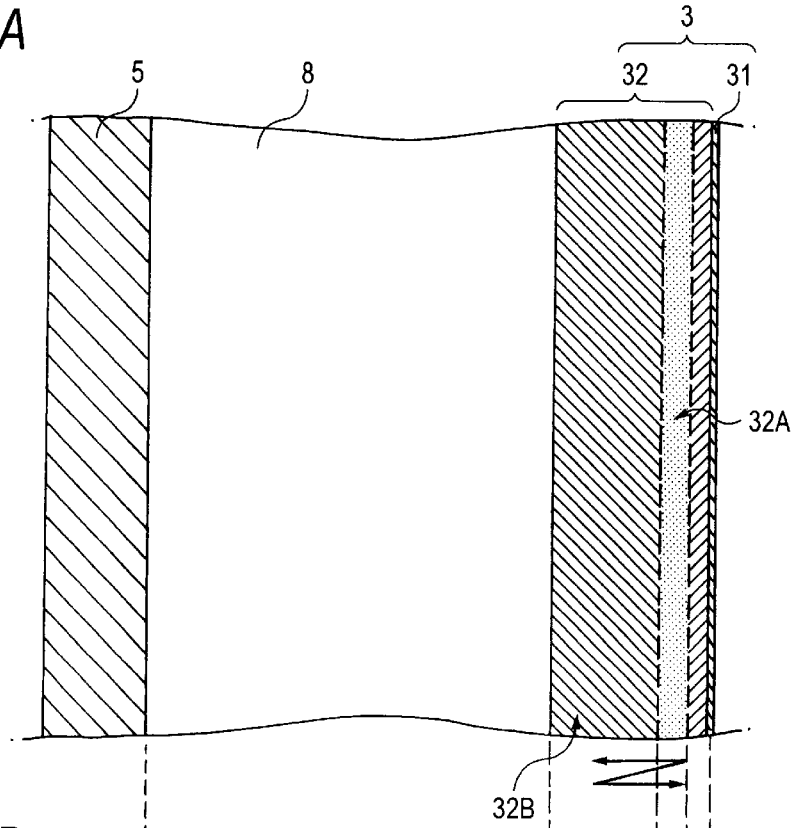
FIGS. 2A and 2B are an enlarged typical view of A portion of the condenser microphone shown in FIG. 1 and a potential profile thereof.
Figure 2B:
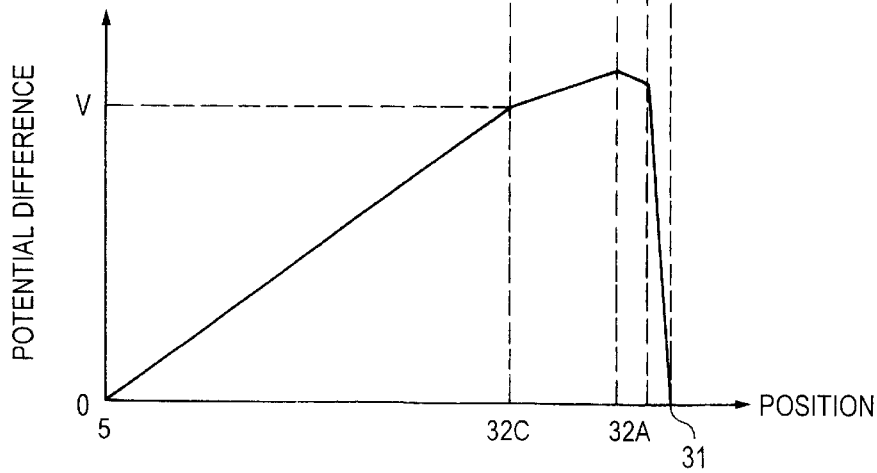

Therefore, as shown in FIG. 2, from the permanent electric charge layer 32A inside the organic dielectric layer 32 to the end surface (hereinafter, called inner end surface) 32C opposite to the air layer 8, it is made into the electret (dielectric in which at least one portion is polarized), (this is called electret layer 32B), and as shown in FIG. 2B, the outside electric field is formed. In this connection, in the present embodiment, although, as the organic dielectric film, FEP (fluoro ethylene.propylene) is used, other than this, for example, PFA (polyfluoro.acetal), or PTFE (polytetra.fluoro ethylene) may be used.

The spacer 4 sets and adjusts the distance between the outside electrode layer 31 and the inside electrode 5, and is formed into almost ring-like whose thickness is 25 $\mu$m, by using appropriately the insulation material, and fixed in the inside of the housing 1 between the outside electrode layer 31 and the inside electrode 5.

The fixed electrode 5 is formed by a predetermined metal, and supported by a step portion 6A of the insulation ring 6. Then, in this fixed electrode 5, air vents 5A for the entrance and exit of the air in the air layer 8 are provided at a plurality of portions. In this connection, in the present embodiment, the thickness of the air layer, that is, the thickness of the spacer 4 is 25 $\mu$m. In this fixed electrode 5, when the diaphragm 3 in FIG. 2A vibrates, for example, left and right, the potential difference V shown in FIG. 2B is varied, and the electric field strength in the air layer 8 due to the potential difference is changed, and from the fixed electrode 5, the output corresponding to the variation amount, is obtained.

Next, the injection method of ion (electric charge) for forming the electret in the organic dielectric layer 32 of the diaphragm 3 will be described. In the prevent embodiment, initially, different from the conventional one, the assembly of the electret condenser microphone is completed, and the outside electrode layer 31 of the diaphragm 3 is electrically grounded. In this connection, in this case, so-called electric charge before assembly (charge) is generated, and in order to prevent the generation of the nonconformity such as the adsorption of the dust due to this, or contact discharge due to carelessness, it is sufficiently washed and dried.

Next, from the outside of this diaphragm 3, by using the electron beam, corona discharge, or the other appropriate means, by the appropriate energy, the oxygen ion is accelerated by, for example, the electric field strength of 100 kV/m-500 kV/m, and as shown in FIG. 1, the oxygen ion or electron is injected from the outside of the outside electrode layer 31 into this outside electrode layer 31.

Thereby, in the inside of the organic dielectric layer 32 of the diaphragm 3, the permanent electric charge layer 32A is formed in the (deep) inner portion receding from the air layer 8, from the middle in the thickness direction of the organic dielectric layer 32, as the result, the surface is charged by a predetermined electric potential, for example, in the present embodiment, the surface potential of 230 V is obtained. In this connection, this surface potential can be appropriately set and adjusted from the dimension of each portion, and the dielectric constant $\epsilon$ of the air occupying the air layer 8 and the sound pressure sensibility as the microphone.

[The Second Embodiment]

Figure 3:
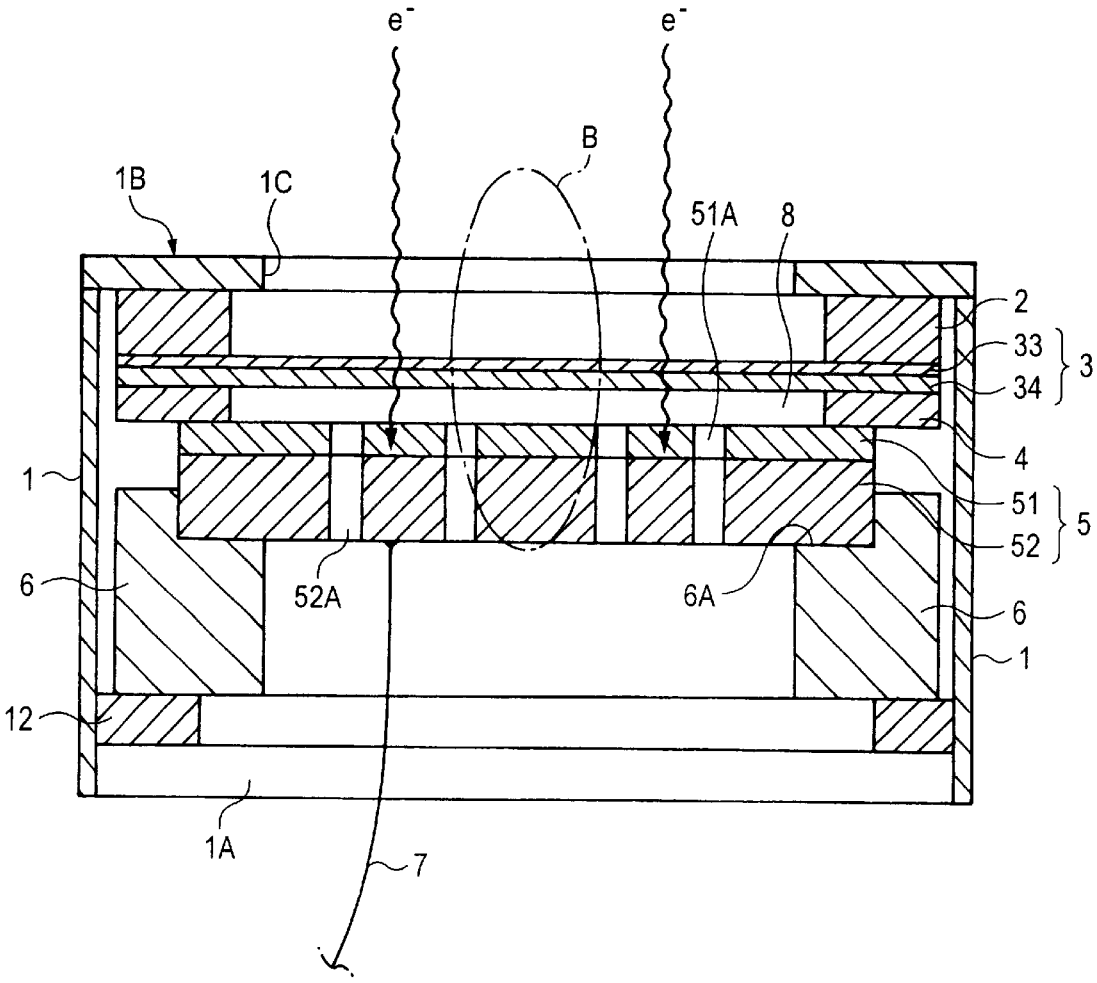
FIG. 3 is an outline sectional view showing the condenser microphone according to the second embodiment of this invention.

FIG. 3 shows an enlarged typical view of a main portion according to the electric sound conversion of the electret condenser microphone according to the second embodiment of this invention. In this connection, in this embodiment, the same reference code is denoted to the same portion as in the first embodiment, and duplex explanations are avoided. In the electret condenser microphone in this embodiment, the electret is formed in the inorganic or organic dielectric layer 51 provided in the conductor fixed electrode (hereinafter, called inner side electrode) 52, not in the dielectric layer 34 side (composed of organic compound) of the conductive diaphragm 3.

In the dielectric layer 34, the thickness is reduced to not larger than 4 $\mu$m, as compared to that in the first embodiment, by an amount in which the electret is not formed, or in order to make the irradiation ion easily penetrate the conductive diaphragm 3, and for example, in this embodiment, 3.5 $\mu$m thick polyester film (PET) is used. In this connection, the outside electrode layer 33, in the same manner as the outside electrode layer 31 in the first embodiment, is structured by the light metal such as aluminium which is made to the film of 0.1 $\mu$m (1000 Å) thickness.

The inside electrode 52 is formed of a predetermined metal, and is supported by an step portion 6A of the same insulation ring 6 as in the first embodiment. In this connection, in this inside electrode 52, air vents 52A are provided at a plurality of portions, integrally with the dielectric layer 51. In this connection, also in this embodiment, the thickness of the air layer 8, that is, the thickness of the spacer 4 is 25 $\mu$m.

The inorganic or organic dielectric layer 51 is one to form the electret, and is structured by the inorganic oxide or organic compound provided on the boundary surface side to the air layer 8 of the conductor fixed electrode 5. In this embodiment, the inorganic material, for example, the thin film of silicon dioxide ($SiO_2$) which is formed into the film of the predetermined thickness of, that is, about 1–50 $\mu$m, is used. Then, it is structured in such a manner that, after each part constituting the condenser microphone is assembled, the oxygen ion (electric charge) or electron is irradiated onto and injected into this inorganic or organic dielectric layer 51 from the outside of the outside electrode layer 33, thereby, in the inside, the permanent electric charge layer 51A (refer to FIG. 4) is formed, and the bias electric charge can be given.

Figure 4A:
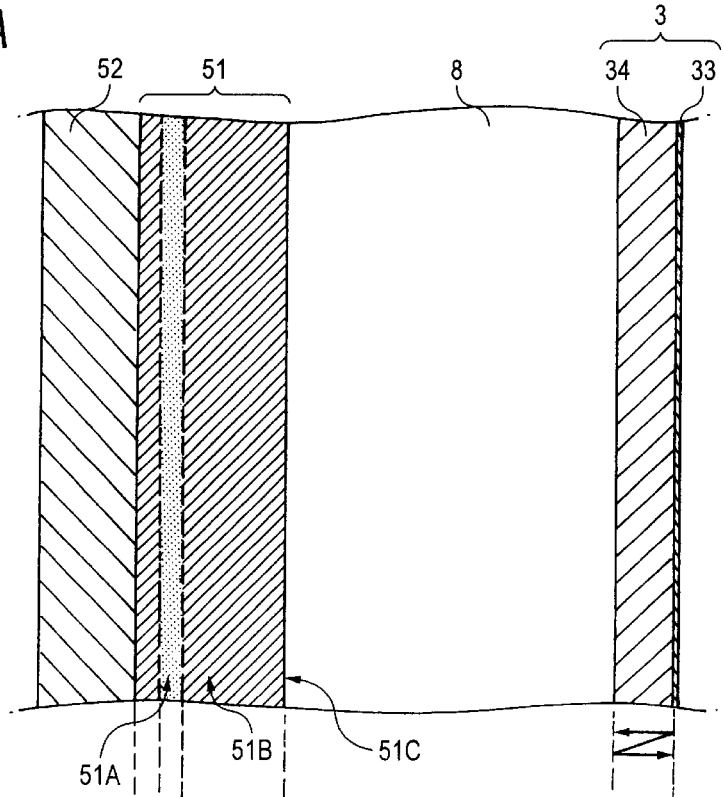
FIGS. 4A and 4B are an enlarged typical view of B portion of the condenser microphone shown in FIG. 3 and a potential profile thereof.
Figure 4B:
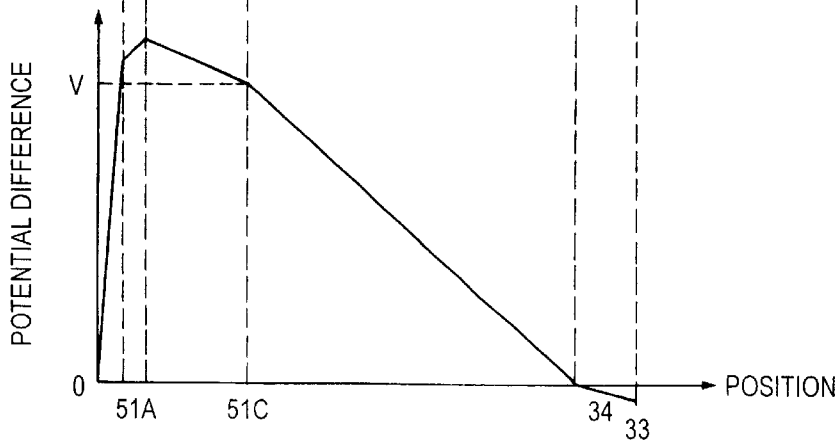
Figure 5:
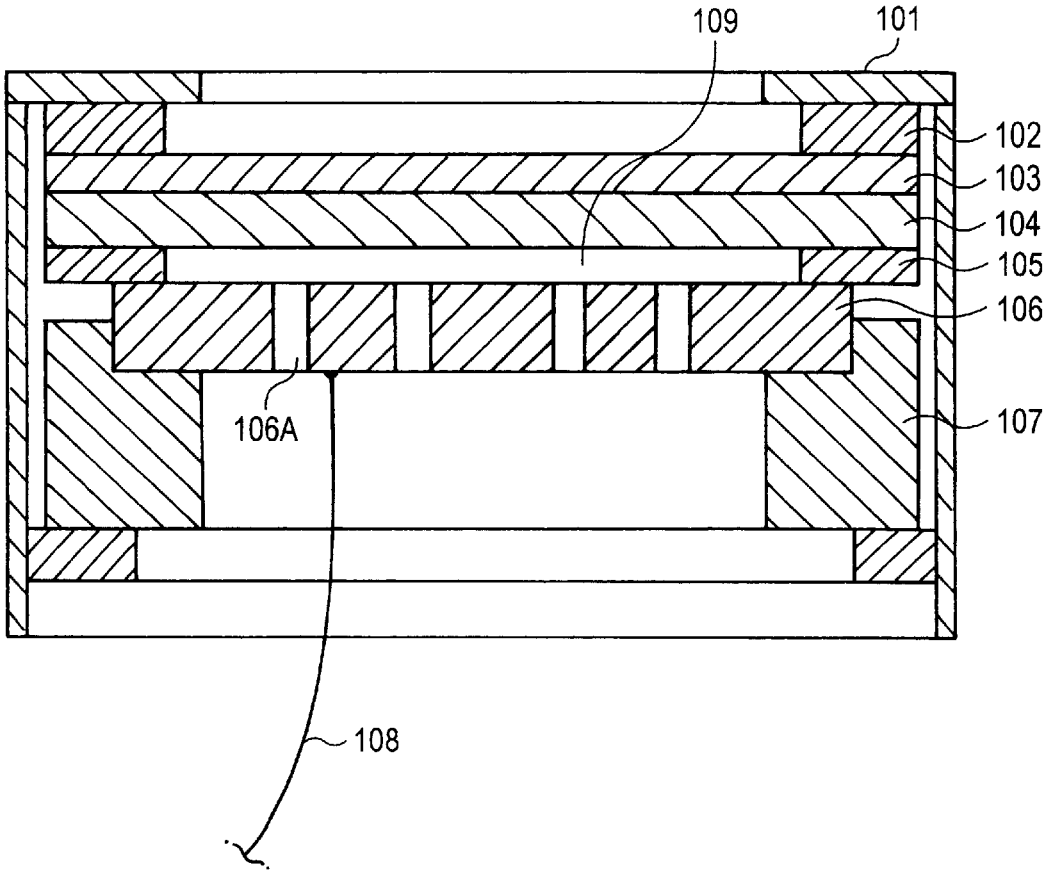
FIG. 5 is an outline sectional view showing the conventional condenser microphone.

That is, as shown in FIG. 4, from the permanent electric charge layer 51 inside the inorganic or organic dielectric layer 51 to the end surface (hereinafter, called inner end surface) 51C contacting with the air layer 8, it is made to the electret (polarization) (this is called electret layer 51B), and as shown in FIG. 4B, the outside electric field is formed. In this connection, in this embodiment, although silicon dioxide ($SiO_2$) is used as the inorganic oxide, in the case of the organic compound, the following material may be used. That is, as the formation material of this dielectric layer 51, not the inorganic material, but the organic compound, for example, FEP (fluoro ethylene propylene), PFA (polyfluoro acetal), or PTFE (polytetra fluoro ethylene) may be used.

Next, the injection method of ion (electric charge) or electron for forming the electret in the inorganic or organic dielectric layer 51, will be described.

Also in this embodiment, different from the conventional one, initially, the assembly of the electret condenser microphone is completed, and the outside electrode layer 33 of the diaphragm 3 is electrically grounded. In this connection, also in this case, so-called electric charge before assembly (charge) is generated, and in order to prevent the generation of the nonconformity such as the adsorption of the dust due to this, or contact discharge due to carelessness, it is sufficiently washed and dried.

Next, from the outside of this conductive diaphragm 3, by using the electron beam, corona discharge, or the other appropriate means, by the appropriate energy, the oxygen ion or electron is accelerated by, for example, the electric field strength of 100 kV/m–500 kV/m, and as shown in FIG. 3, the oxygen ion or electron is injected from the outside of the outside electrode layer 33.

Thereby, the oxygen ion or electron which is accelerated and given with the high energy penetrates the diaphragm 3 and enters into the inner portion deeper than the middle in the thickness direction of the inorganic or organic dielectric layer 51, and the permanent electric charge layer 51A is formed. As the result, in the inorganic or organic dielectric layer 51, the surface potential is charged to several tens V on the boundary surface side to the air layer 8. This surface potential can be appropriately adjusted and set from the dimension of each portion, and the dielectric constant $\epsilon$ of the air occupying the air layer 8 and the sound pressure sensitivity as the microphone.

As described above, in this invention, the conductive diaphragm has the earth electrode layer formed of the conductive light metal, and the permanent electric charge layer has the structure structured by ion or electron formed in the inner portion receding from the air layer side, from the middle in the thickness direction of the organic dielectric layer inside the organic dielectric layer, or the structure composed of ion or electron formed in the inner portion receding from the air layer side, compared to the middle position in the thickness direction of the inorganic or organic dielectric layer in the inside of the inorganic or organic dielectric layer.

Accordingly, according to this invention, a condenser microphone in which the high reliable one can be realized, in such a manner that the electric charge can be injected from the light metal coating surface after the assembly of the microphone, and not only the assembly becomes easy, but after the dielectric is sufficiently washed, it is maintained in the hermetically sealed condition, and is strong to the water or humidity, and even under the condition that the environmental condition such as the humidity or temperature is severe, the excellent electric sound conversion characteristic can also be maintained, can be provided.

What is claimed is:

1. A condenser microphone comprising:

a conductive diaphragm having an earth electrode layer formed of a conductive light metal;

a conductor fixed electrode arranged opposite to the conductive diaphragm through an air layer;

an organic dielectric layer formed of the organic compound provided on the boundary surface side between the air layer and the conductive diaphragm; and a permanent electric charge layer composed of ions or electrons formed on the earth electrode layer side from a middle position in the thickness direction of the organic dielectric layer in the inside of the organic dielectric layer.

2. A condenser microphone according to claim 1, wherein the inside of the organic dielectric layer from the permanent electric charge layer to the inner end surface contacting the air layer is made to the electret and has the electric potential.

3. A condenser microphone according to claim 1, wherein the organic dielectric layer has 1 to 50 mm film thickness, and the earth electrode layer is formed by covering the film of the conductive light metal of the thickness not larger than 0.1 mm on the organic dielectric layer.

4. A condenser microphone comprises:

a conductive diaphragm having an earth electrode layer formed of a conductive light metal;

a conductor fixed electrode arranged opposite to the conductive diaphragm through an air layer;

an inorganic or organic dielectric layer formed of the inorganic oxide or the organic compound provided on the boundary surface side to the air layer of the conductor fixed electrode; and a permanent electric charge layer composed of ions or electrons formed on the conductor fixed electrode side from the middle in the thickness direction of the inorganic or organic dielectric layer in the inside of the inorganic or organic dielectric layer.

5. A condenser microphone according to claim 4, wherein the inside of the inorganic or organic dielectric layer from the permanent electric charge layer to the inner end surface contacting with the air layer is made to the electret and has the electric potential.

6. A condenser microphone according to claim 4, wherein the dielectric layer of not larger than 4 mm thickness formed of the organic compound is used for the conductive diaphragm, and on the organic dielectric layer, the earth electrode layer is provided by forming the film of the conductive light metal in the thickness not larger than 0.1 mm.

7. A condenser microphone according to claim 4, wherein the silicon dioxide ($SiO_2$) of not smaller than 1 mm thickness is used for the inorganic or organic dielectric layer.

8. A condenser microphone according to any one of claims 1 to 7, wherein the organic dielectric layer is formed by using any one of FEP (fluoro ethylene.propylene), PFA (polyfluoro.acetal), and PTFE (polytetra.fluoroethylene).

9. A condenser microphone according to any one of claims 1 to 7, wherein a circular hole whose inner diameter is not smaller than 1.0 mm is formed on the outer surface of a housing which accommodates the conductive diaphragm and the conductive fixed electrode.

* * * * *

UNITED STATES PATENT AND TRADEMARK OFFICE

CERTIFICATE OF CORRECTION

PATENT NO. : 6,731,766 B2 
DATED : May 4, 2004
INVENTOR(S) : Yoshinobu Yasuno et al.

It is certified that error appears in the above-identified patent and that said Letters Patent is hereby corrected as shown below:

Column 1,
Line 37, please delete "developed," and insert therefor -- developed. --

Column 3,
Line 9, after "(polytetra.fluoroethylene)", please insert -- . -- (period)

Column 8,
Line 38, please delete "50 mm" and insert therefor -- 50 μm --.
Line 41, please delete "0.1 mm" and insert therefor -- 0.1 μm --.
Line 62, please delete "4 mm" and insert therefor -- 4 μm --.
Lines 66-67, please delete "0.1 mm" and insert therefor -- 0.1 μm --.

Column 9,
Line 2, please delete "1 mm" and insert therefor -- 1 μm --.

Signed and Sealed this

Tenth Day of August, 2004

JON W. DUDAS
*Acting Director of the United States Patent and Trademark Office*